US009222370B2

(12) United States Patent
Cukjati et al.

(10) Patent No.: US 9,222,370 B2
(45) Date of Patent: Dec. 29, 2015

(54) STEAM TURBINE IN A THREE-SHELLED DESIGN

(75) Inventors: Christian Cukjati, Oberhausen (DE); Heinz Dallinger, Mülheim an der Ruhr (DE); Thomas Müller, Heiligenhaus (DE); Rainer Quinkertz, Essen (DE); Norbert Thamm, Essen (DE); Andreas Ulma, Mülheim an der Ruhr (DE); Michael Wechsung, Mülheim an der Ruhr (DE); Uwe Zander, Mülheim an der Ruhr (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 743 days.

(21) Appl. No.: 13/515,354

(22) PCT Filed: Dec. 14, 2010

(86) PCT No.: PCT/EP2010/069576

§ 371 (c)(1),
(2), (4) Date: Jun. 12, 2012

(87) PCT Pub. No.: WO2011/082984

PCT Pub. Date: Jul. 14, 2011

(65) Prior Publication Data

US 2012/0257959 A1 Oct. 11, 2012

(30) Foreign Application Priority Data

Dec. 15, 2009 (EP) ..... 09015540

(51) Int. Cl.
*F01D 25/24* (2006.01)
*F01D 25/26* (2006.01)

(52) U.S. Cl.
CPC ..... *F01D 25/26* (2013.01); *F05D 2220/31* (2013.01)

(58) Field of Classification Search
CPC ..... F01D 25/26; F01D 9/047; F05D 2220/31
USPC ..... 415/108, 215.1
See application file for complete search history.

(56) References Cited

U.S. PATENT DOCUMENTS 4,550,569 A 11/1985 Isa et al.
4,840,537 A * 6/1989 Silvestri, Jr. ..... 415/202
6,007,767 A * 12/1999 Fujita et al. ..... 420/38
7,165,934 B2 1/2007 Reigl
7,594,795 B2 9/2009 Kriz et al.

(Continued)

FOREIGN PATENT DOCUMENTS

DE 3421067 A1 12/1984
DE 10353451 A1 6/2005

(Continued)

OTHER PUBLICATIONS

Tanaka Y et al: "Advanced Design of Mitsubishi Large Steam Turbines", Mitsubishi Heavy Industries, Power Gen Europe, 2003, Düsseldorf, May 6-8, 2003; pp. 1-17.

*Primary Examiner* — Dwayne J White
*Assistant Examiner* — Jason Fountain

(57) ABSTRACT

A turbomachine including a rotor and an inner interior housing an outer interior housing and an exterior housing, wherein the turbomachine has a first flow and a second flow arranged opposite the first flow for a high-pressure blading or medium-pressure blading, wherein the inner interior housing is made of a higher quality material tan the outer interior housing and solely accommodates the high-pressure and medium-pressure inflow regions including the balance piston is provided.

10 Claims, 1 Drawing Sheet

(56) References Cited

U.S. PATENT DOCUMENTS

| | | | | |
|---|---|---|---|---|
| 2007/0166152 | A1 | 7/2007 | Ulma | |
| 2008/0213085 | A1 | 9/2008 | Kostenko | |
| 2011/0280720 | A1* | 11/2011 | Dallinger et al. | 415/208.1 |

FOREIGN PATENT DOCUMENTS

| | | | |
|---|---|---|---|
| DE | 102006027237 | A1 | 12/2006 |
| EP | 1033478 | A2 | 9/2000 |
| EP | 1744017 | A1 | 1/2007 |
| JP | S57059401 | A | 5/1977 |
| JP | S59229003 | A | 12/1984 |
| JP | 60195304 | | 10/1985 |
| JP | H1089013 | A | 4/1998 |
| JP | 2000282808 | A | 10/2000 |
| JP | 2007519851 | A | 7/2007 |
| JP | 2008508471 | A | 3/2008 |
| WO | WO 2007006754 | A1 | 1/2007 |

* cited by examiner

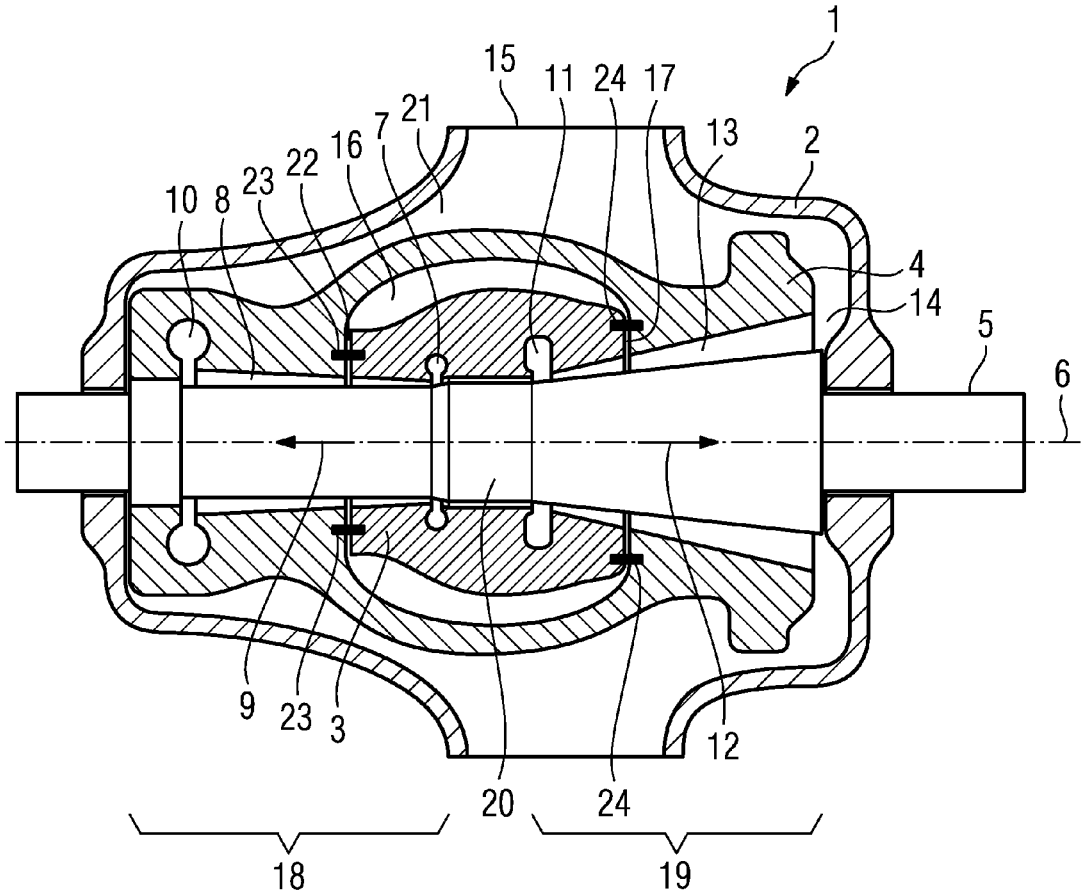
1
15
11
24
17
21
7
16
22
23
8
10
13
2
4
14
5
6
9
23
3
20
24
12
18
19

STEAM TURBINE IN A THREE-SHELLED DESIGN

CROSS REFERENCE TO RELATED APPLICATIONS

This application is the US National Stage of International Application No. PCT/EP2010/069576, filed Dec. 14, 2010 and claims the benefit thereof. The International Application claims the benefits of European Patent Office application No. 09015540.9 EP filed Dec. 15, 2009. All of the applications are incorporated by reference herein in their entirety.

FIELD OF INVENTION

The invention relates to a turbomachine, comprising a rotor mounted rotatably about an axis of rotation, an internal inner casing arranged around the rotor and an external inner casing, an outer casing being arranged around the internal inner casing and the external inner casing, the turbomachine having a first flow designed for high-pressure steam and a second flow designed for medium-pressure steam, the second flow being oriented opposite to the first flow.

BACKGROUND OF INVENTION

A turbomachine is understood to mean, for example, a steam turbine. A steam turbine usually has a rotatably mounted rotor and a casing which is arranged around the rotor. A flow duct is formed between the rotor and the inner casing. The casing in a steam turbine has to be able to fulfill a plurality of functions. Firstly, the guide blades in the flow duct are arranged on the casing and, secondly, the inner casing must withstand the pressure and temperatures of the flow medium for all load situations and special operating situations. In the case of a steam turbine, the flow medium is steam. Furthermore, the casing must be designed in such a way that supplies and discharges, which are also designated as bleeds, are possible. A further function which a casing must fulfill is the possibility that a shaft end can be led through the casing.

Under the high stresses, pressures and temperatures occurring during operation, it is necessary that the materials are suitably selected and the design is selected in such a way that mechanical integrity and functionality become possible. For this purpose, it is necessary to use high-grade materials, particularly in the region of the inflow and of the first guide blade grooves.

For applications at fresh steam temperatures of above 650° C., such as, for example, 700° C., nickel-based alloys are suitable, since they withstand the loads occurring at high temperatures. However, the use of such a nickel-based alloy entails new challenges. Thus, the costs of nickel-based alloys are comparatively high, and moreover the producibility of nickel-based alloys is limited, for example, because of the restricted possibility for casting. The result of this is that the use of nickel-based materials must be minimized. Furthermore, nickel-based materials are poor heat conductors. The temperature gradients across the wall thickness are therefore so rigid that thermal stresses are comparatively high. Further, account must be taken of the fact that, when nickel-based materials are used, the temperature difference between the inlet and the outlet of the steam turbine rises.

Various concepts are adapted at the present time for providing a steam turbine which is suitable for high temperatures and high pressures. Thus, it is known to incorporate an inner casing structure comprising a plurality of parts into an outer casing structure, according to the Article Y. Tanaka et al. "Advanced Design of Mitsubishi Large Steam Turbines", Mitsubishi Heavy Industries, Power Gen Europe, 2003, Dusseldorf, May 6-8, 2003.

It is also known to produce an inner casing from two parts according to DE 10 2006 027 237 A1.

A multi-component inner casing structure is likewise disclosed in DE 342 1067 and in DE 103 53 451 A1.

SUMMARY OF INVENTION

In a particular embodiment of the turbomachine, the high-pressure part and the medium-pressure part are accommodated in an outer casing. The high-pressure part is acted upon with fresh steam which usually has the highest steam parameters, such as temperature and pressure, and which flows directly from the steam generator to the high-pressure subturbine.

The steam flowing out of the high-pressure part after expansion is conducted out of the steam turbine again and routed to a reheater unit of a boiler, in order to be heated again there to a higher temperature which can correspond to the fresh steam temperature. This reheated steam is subsequently conducted again into the medium-pressure part of the turbomachine and then flows through a medium-pressure blading. The high-pressure part and medium-pressure part in this case have flow directions arranged opposite one another. Such embodiments are called reverse-flow turbomachines. However, turbomachines are also known which are manufactured in what is known as a single-flow design. In this design, the high-pressure part and the medium-pressure part are arranged one after the other and the flow passes through them in the same flow direction.

The object of the invention is to afford a further possibility for designing a turbomachine.

This object is achieved by means of the features of the claims. Advantageous developments are specified in the subclaims.

An essential idea of the invention is to design a three-shelled steam turbine. The inner casing is in this case formed into an internal inner casing and an external inner casing. The internal inner casing is arranged in the region of the inflow region and therefore must withstand the high temperatures and high pressures. The internal inner casing is therefore made from a suitable material, such as, for example, from a nickel-based alloy or from a higher-grade material, such as, for example, a steel which comprises 9-10% by weight of chromium. The flow duct is formed between the internal inner casing and the rotor. The internal inner casing therefore has devices, such as, for example, grooves, in order to carry guide blades therein. An external inner casing is arranged around the inner casing.

It is essential in this case that a cooling steam space, which is acted upon by cooling medium, is obtained between the internal inner casing and the external inner casing. The external inner casing is in this case designed in such a way that, as seen in the flow direction, it is adjacent to the internal inner casing and forms a boundary of the flow duct, there also being provided in the external inner casing devices, such as, for example, grooves, so that guide blades can be carried.

The external inner casing is acted upon, by steam being introduced into the cooling steam space, by a steam which has a lower temperature and a lower pressure, so that the material of the external inner casing needs to be less heat-resistant than the material of the internal inner casing. In particular, it is sufficient if the external inner casing is formed from a lower-grade material. An outer casing is arranged around the internal inner casing and the external inner casing.

The turbomachine has a first flow which is acted upon by a high-pressure steam and which flows in a first flow direction. Furthermore, the turbomachine has a second flow which is acted upon by medium-pressure steam and which flows in a second flow direction. The second flow direction is opposite to the first flow direction, so that this turbomachine has what is known as a reverse-flow design. The high-pressure inflow region and the medium-pressure inflow region are surrounded or formed by an internal inner casing. The internal inner casing is manufactured from a higher-grade material and accommodates only the high-pressure and the medium-pressure inflow, including the balancing piston and the guide blade grooves, to the stage which is absolutely necessary for temperature and strength reasons. As a result, the internal inner casing can be kept compact and manufactured in a space-saving way and, furthermore, has a lower weight.

A cooling steam flow line is provided for the flow of cooling steam into the cooling steam space. The cooling steam flow line is connected fluidically to the second flow. This means that the medium-pressure steam flows predominantly into the cooling steam space which has ideal steam parameters for suitably cooling the internal inner casing.

The first flow has a high-pressure outflow region and the second flow has a medium-pressure outflow region, the external inner casing extending from the high-pressure outflow region as far as the medium-pressure outflow region. The external inner casing therefore extends virtually over the entire blading region of the rotor, the external inner casing having devices for carrying guide blades. However, it is not the entire flow region with guide blades which is formed in the external inner casing. In the region of the internal inner casing, no guide blades are arranged in the external inner casing. In this region, the internal inner casing is sheathed by the external inner casing. The external inner casing is in this case formed from an upper part and a lower part. The upper part and the lower part are formed, in turn, from one piece and extend over the first . and the second flow.

In an advantageous development, the external inner casing is formed along the first flow and the second flow.

In an advantageous development, a cooling steam space is formed between the internal inner casing and the external inner casing. The cooling steam located between the internal inner casing and the external inner casing during operation constitutes at the same time insulation with respect to the external inner casing which surrounds the cooling steam space and the internal inner casing and forms the expansion path downstream of the cooling steam extraction.

The external inner casing is in contact with this cooling steam and can therefore be manufactured or formed from a lower-grade material than the internal inner casing. Furthermore, the primary and secondary stresses in the external inner casing are influenced solely by the difference between the steam state of the steam in the cooling steam space and that of the medium-pressure exhaust steam. Primary stresses are mechanical stresses which arise as a result of external loads, for example due to steam pressures, weight forces and the like. Secondary stresses are to be understood, for example, as being thermal stresses and constitute mechanical stresses which arise as a result of unbalanced temperature fields or obstructions to heat expansions (thermal constraints).

The turbomachine is designed, inter alia in the cooling steam space, with a dewatering line which, in the event of a stoppage or a starting operation, diverts condensation water occurring or, in the event of a failure of a bleed which could be implemented, for example, by the extraction of steam from the cooling space via nipples, ensures sufficient residual flow conduction.

In an advantageous development, the cooling steam space is designed with a cooling steam outflow line for the outflow of cooling steam from the cooling steam space. The outflow of the cooling steam from the cooling steam space which is continual during operation gives rise to very good cooling, and therefore the material duty loads (in particular, primary and secondary stresses) in the turbomachine become lower.

In an advantageous development, the high-pressure outflow region is connected to a reheater line. As a result, the high-pressure steam can be conducted to a reheater and can be heated from a low temperature to a high temperature.

The internal inner casing is in this case formed from a higher-grade material than the external inner casing. In a first embodiment, the internal inner casing is formed from a high-chromium material which comprises 9-10% by weight of chromium. In a second advantageous development, the inner casing is formed from a nickel-based material. The external inner casing is formed from a material which comprises 1-2% by weight of chromium.

BRIEF DESCRIPTION OF THE DRAWINGS

Exemplary embodiments of the invention are described below by means of the drawing. The drawing is not intended to illustrate the exemplary embodiments true to scale, and instead the drawing is executed in diagrammatic and/or slightly distorted form. As regards additions to the teachings which can be recognized directly from the drawing, reference is made here to the relevant prior art.

In particular, in the drawing:

FIG. 1 shows a sectional illustration through a two-flow steam turbine.

DETAILED DESCRIPTION OF INVENTION

The steam turbine 1 illustrated in FIG. 1 is an embodiment of a turbomachine. The steam turbine 1 comprises an outer casing 2, an internal inner casing 3, an external inner casing 4 and a rotatably mounted rotor 5. The rotor 5 is mounted rotatably about an axis of rotation 6. The outer casing 2 is formed from an upper part and a lower part, the upper part being illustrated above the axis of rotation 6 and the lower part below the axis of rotation 6 in the drawing plane. Both the internal inner casing 3 and the external inner casing 4 likewise have an upper part and a lower part which, as in the case of the outer casing 2, are arranged above and below the axis of rotation 6. The internal inner casing 3, the external inner casing 4 and the outer casing 2 therefore have in each case a horizontal parting plane.

During operation, a high-pressure steam flows into a high-pressure inflow region 7. The high-pressure steam subsequently flows along a first flow direction 9 through a blading 8, not illustrated in any more detail, which comprises guide blades and moving blades. The moving blades are in this case arranged on the rotor 5 and the guide blades are arranged on the internal inner casing 3 and external inner casing 4. The temperature and the pressure of the high-pressure steam are thereby reduced. The high-pressure steam then flows out of a high-pressure outflow region 10 from the turbomachine to a reheater unit, not illustrated in any more detail. What is also not illustrated is the fluidic connection between the high-pressure outflow region 10 and the reheater unit.

After the high-pressure steam has been heated to high temperature again after reheating, this steam flows as medium-pressure steam via a medium-pressure inflow region 11 in a second flow direction 12 along a medium-pressure blading 13. The medium-pressure blading 13 has guide and moving blades, not illustrated in any more detail. The moving blades are in this case arranged on the rotor 5 and the guide blades are arranged on the internal inner casing 3 and the external inner casing 4. The medium-pressure steam flowing through the medium-pressure blading 13 subsequently flows out of a medium-pressure outflow region 14 from the external inner casing 4 and subsequently flows via an outflow nipple 15 out of the turbomachine 1. The internal inner casing 3 and the external inner casing 4 are arranged around the rotor 5. The outer casing 2 is arranged around the internal inner casing 3 and the external inner casing 4. The internal inner casing 3 is formed in the region of the high-pressure inflow region 7 and the medium-pressure inflow region 11. Since the temperatures of the steam are highest in the high-pressure inflow region 7 and in the medium-pressure inflow region 11, the internal inner casing 3 is manufactured from a higher-grade material.

In a first embodiment, the internal inner casing 3 is formed from a nickel-based alloy. In a second embodiment, the internal inner casing 3 is formed from a higher-grade material which comprises 9-10% by weight of chromium. The external inner casing 4 can be formed from a lower-grade material. In one embodiment, the internal outer casing may be formed from a steel with 1-2% by weight of chromium.

The external inner casing 4 extends at least from the high-pressure outflow region 10 along the axis of rotation 6 as far as the medium-pressure outflow region 14. This means that the internal inner casing 3 is arranged within the external inner casing 4 in the region of the high-pressure inflow region 7 and the medium-pressure inflow region 11. A cooling steam space 16 is formed between the internal inner casing 3 and the external inner casing 4. This cooling steam space 16 is designed with a cooling steam flow line for the inflow of cooling steam. The cooling steam 16 is extracted from the medium-pressure blading 13 at a suitable location and may, for example, be extracted at a gap 17 between the internal inner casing 3 and the external inner casing 4. In this case, the cooling steam space 16 must be sealed off with respect to the blading 8. The cooling steam could be supplied selectively via the gap 17 from the medium-pressure blading 13 or via a second gap 22 from the blading 8. The other side in each case would have to be closed by means of a suitable first seal 23 or second seal 24.

The external inner casing 4 is formed along the first flow 18 and the second flow 19. The cooling steam flow line is not illustrated in any more detail in the figure. The external inner casing 4 has a cooling steam outflow line for the outflow of cooling steam from the cooling steam space 16. In other words, the internal inner casing 3 accommodates the high-pressure inflow region 7 and the medium-pressure inflow region 11, including a balancing piston 20 and guide blade groves, not illustrated in any more detail, to the stage which is absolutely necessary for temperature and strength reasons. The internal inner casing 3 is therefore relatively small and consequently cost-effective and, because of the low tonnage, enables a broader range of potential suppliers to be achieved.

The cooling steam flowing out of the cooling steam space 16 again leads to a good cooling effect. This outflowing cooling steam may, for example, be routed through the external inner casing 4 into an exhaust steam space 21 or, for example, may be discharged by means of a bleed. The internal inner casing 3 and the external inner casing 4 are sealed off with respect to one another by means of seals. In the cooling steam space 16 there is a dewatering line, not illustrated in any more detail, which, in the event of a stoppage or starting operation of the steam turbine 1, diverts condensation water occurring or, in the event of a failure of the bleed, ensures sufficient residual flow conduction.

The internal inner casing 3, the external inner casing 4 and the outer casing 2 are of pressure-bearing design.

The invention claimed is:

1. A turbomachine, comprising:

a rotor mounted rotatably about an axis of rotation;

an internal inner casing arranged around the rotor;

an external inner casing; and an outer casing being arranged around the internal inner casing and the external inner casing, wherein the turbomachine includes a first flow designed for high-pressure steam and a second flow designed for medium-pressure steam, the second flow being oriented opposite to the first flow, the first flow having a high-pressure inflow region and the second flow a medium-pressure inflow region, wherein the internal inner casing is arranged around the high-pressure inflow region and the medium-pressure inflow region, a cooling steam space is formed between the internal inner casing and the external inner casing sealed off with respect to a blading;

a cooling steam flow line is provided for the inflow of cooling steam into the cooling steam space, wherein the cooling steam flow line is connected fluidically to the second flow, wherein the first flow has a high-pressure outflow region and the second flow a medium-pressure outflow region, and wherein the external inner casing extends from the high-pressure outflow region as far as the medium-pressure outflow region.

2. The turbomachine as claimed in claim 1, wherein the external inner casing is formed along the first flow and the second flow.

3. The turbomachine as claimed in claim 1, wherein the cooling steam space is designed with a cooling steam outflow line for the outflow of cooling steam from the cooling steam space.

4. The turbomachine as claimed in claim 1, wherein the high-pressure outflow region is connectable to a reheater line.

5. The turbomachine as claimed in claim 1, wherein the internal inner casing is formed from a higher-grade material than the external inner casing.

6. The turbomachine as claimed in claim 5, wherein the internal inner casing is formed from a high-chromium material which comprises 9-10% by weight of chromium.

7. The turbomachine as claimed in claim 5, wherein the internal inner casing is formed from a nickel-based material.

8. The turbomachine as claimed in claims 5, wherein the external inner casing is formed from a material which comprises 1-2% by weight of chromium.

9. The turbomachine as claimed in claims 6, wherein the external inner casing is formed from a material which comprises 1-2% by weight of chromium.

10. The turbomachine as claimed in claims 7, wherein the external inner casing is formed from a material which comprises 1-2% by weight of chromium.

* * * * *